US011231200B1

(12) United States Patent
Hoog et al.

(10) Patent No.: US 11,231,200 B1
(45) Date of Patent: Jan. 25, 2022

(54) TRACKING AND EVALUATING THE PERFORMANCE OF A HVAC SYSTEM

(71) Applicants: Klaus D. Hoog, Oriental, NC (US); Eric P. Hoog, Oriental, NC (US)

(72) Inventors: Klaus D. Hoog, Oriental, NC (US); Eric P. Hoog, Oriental, NC (US)

( * ) Notice: Subject to any disclaimer, the term of this patent is extended or adjusted under 35 U.S.C. 154(b) by 0 days.

(21) Appl. No.: 17/489,109

(22) Filed: Sep. 29, 2021

Related U.S. Application Data

(60) Provisional application No. 63/084,843, filed on Sep. 29, 2020.

(51) Int. Cl.

| | |
|---|---|
| ***F24F 11/38*** | (2018.01) |
| ***F24F 11/64*** | (2018.01) |
| ***F24F 11/58*** | (2018.01) |
| *F24F 110/20* | (2018.01) |
| *F24F 110/10* | (2018.01) |

(52) U.S. Cl.
CPC ..... *F24F 11/38* (2018.01); *F24F 11/58* (2018.01); *F24F 11/64* (2018.01); *F24F 2110/10* (2018.01); *F24F 2110/20* (2018.01)

(58) Field of Classification Search
CPC .. F24F 11/38; F24F 11/46; F24F 11/64; F24F 2110/12; F24F 2110/20
See application file for complete search history.

(56) References Cited

U.S. PATENT DOCUMENTS

| | | | |
|---|---|---|---|
| 4,432,232 | A | 2/1984 | Brantley et al. |
| 4,611,470 | A | 9/1986 | Enstrom |
| 4,897,798 | A | 1/1990 | Cler |
| 5,259,553 | A | 11/1993 | Shyu |
| 5,386,461 | A | 1/1995 | Gedney |
| 5,592,058 | A | 1/1997 | Archer et al. |
| 5,682,329 | A | 10/1997 | Seem et al. |
| 6,385,510 | B1 | 5/2002 | Hoog |
| 8,019,567 | B2 | 9/2011 | Steinberg |
| 8,423,322 | B2 | 4/2013 | Steinberg |
| 8,886,488 | B2 | 11/2014 | Steinberg |
| 9,092,040 | B2 | 7/2015 | Fadell |
| 10,747,243 | B2 | 8/2020 | Barton |
| 10,884,403 | B2 | 1/2021 | Arensmeier |
| 10,935,271 | B2 | 3/2021 | Reeve |
| 10,989,427 | B2 | 4/2021 | Maslekar |

(Continued)

OTHER PUBLICATIONS

Sensi Predict smart HVAC obtained from Sensi Predict smart HVAC | Sensi US (emerson.com) on Sep. 28, 2021 9 pages as printed. Emerson Electric. Co., Ferguson, Missouri, U.S.

(Continued)

*Primary Examiner* — Mohammad Ali
*Assistant Examiner* — Vincent W Chang
(74) *Attorney, Agent, or Firm* — Kevin E Flynn; Flynn IP Law

(57) ABSTRACT

Devices and methods for assessing the performance and efficiency of an HVAC system using a tuple including a percentage of runtime over a lookback window coupled with a ΔT value for the difference between the HVAC setpoint and the outdoor temperature. The performance monitoring may be done using a device that is independent of the HVAC thermostat or may be incorporated within a smart thermostat. Trends in measured tuples over time can warn of system degradation.

21 Claims, 11 Drawing Sheets

(56) References Cited

U.S. PATENT DOCUMENTS

| | | | | |
|---|---|---|---|---|
| 2012/0125592 | A1* | 5/2012 | Fadell | G05B 15/02 165/201 |
| 2012/0158350 | A1* | 6/2012 | Steinberg | G05B 19/048 702/130 |
| 2017/0361259 | A1* | 12/2017 | Fox | B01D 46/0086 |
| 2019/0234638 | A1* | 8/2019 | Song | F24F 11/52 |
| 2019/0264936 | A1* | 8/2019 | Bailey | F24F 11/30 |
| 2019/0293316 | A1* | 9/2019 | Reeve | F24F 11/52 |
| 2020/0248921 | A1 | 8/2020 | Marshall | |
| 2020/0309400 | A1* | 10/2020 | Vettigli | G05B 13/042 |
| 2021/0071888 | A1* | 3/2021 | Mowris | F24F 11/755 |

OTHER PUBLICATIONS

Hearn, Patrick, These smartAC.com sensors keep an eye on the health of your HVAC system, digitaltrends(R) web site (https://www.digitaltrends.com/home/monitor-your-hvac-system-with-smartaccom-smart-sensors/), Jun. 2, 2020, 13 pages as printed, Digital Trends owned by Designtechnica, Portland, Oregon.

* cited by examiner

TRACKING AND EVALUATING THE PERFORMANCE OF A HVAC SYSTEM

PRIORITY CLAIM

This application claims the benefit of U.S. Provisional Patent Application No. 63/084,843 filed Sep. 29, 2020 for Device and method for tracking and evaluating the performance of a heating, ventilation, and air conditioning (HVAC) system. The '843 application is incorporated by reference herein in its entirety.

BACKGROUND

Field of the Disclosure

This disclosure relates generally to the field of heating, ventilation and air conditioning (HVAC) monitoring devices and, more particularly, to apparatuses and methods for continuously monitoring the performance of a forced air HVAC system.

Unmet Needs.

Actual field surveys have shown that most HVAC systems tested are operating below the manufacturer's specifications. In other words, most HVAC systems are not operating at the manufacturer's stated level of efficiency. A small deviation from those efficiency specifications can mean a large increase in energy consumption. For example, a system where 10% of the coolant has leaked out can lose almost two Seasonal Energy Efficiency Ratio (SEER) rating points, and a system where 23% of the coolant has leaked out can have a 52% loss of efficiency with a corresponding increase in energy bills for the homeowner.

To keep their HVAC units operating at peak efficiency, homeowners are urged by their system manufacturers and their contractors to schedule regular system maintenance. A standard maintenance call includes changing all filters, checking coolant levels and recharging, if necessary, cleaning coils and heat transfer surfaces, and making sure all air flow is unobstructed and free from dirt, foliage, etc.

There are a number of problems with regularly scheduled maintenance. If the coolant levels are correct, the filters are clean, and there are no other problems, the maintenance call may not have been necessary. This results in unnecessary expense and inconvenience for the homeowner. A regularly scheduled maintenance cannot see into the future. If regularly scheduled system maintenance has just been performed, a leak may develop, or a component may malfunction shortly after the maintenance call. Unless the problem is severe enough to cause a complete system breakdown, the problem may not be noticeable to the homeowner for up to a year or until the next regularly scheduled maintenance. This long gap between problem onset and problem detection at the next regularly scheduled maintenance could result in ever increasing utility bills for the homeowner, and it could result in permanent damage to the HVAC system, severely shortening its life expectancy.

There is a need in the marketplace for a monitoring device or system that continuously monitors the performance of a heating and air-conditioning in a home. This system should alert the homeowner if their HVAC (Heating, Ventilation, and Air Conditioning) system is not performing at optimum levels.

There are currently several residential HVAC performance monitors on the market. These monitors require the installation of one or more sensors in the duct work and/or at various critical locations throughout the system, and they must be in communication with the HVAC system thermostat. Sensi™ Predict Smart HVAC is an example. See https://sensi.emerson.com/en-us/products/sensi-predict.

There is, therefore, an unmet need in the current marketplace for a new monitoring device that addresses and corrects the shortcomings of the monitoring systems described above, and that:

Does not require professional installation.

Is not linked to, and operates independently of any thermostat

Vocabulary.

A, An.

In this application, and the claims that follow, the terms a, an, or the identification of a single thing should be read as at least one unless such an interpretation is impossible within the context of the entirety of the specification. For example, the use of the terms sole, only, or the phrase not more than one would indicate that a single item is intended.

Gne and Gnes.

To avoid the awkward he/she and his/her or the potentially confusing singular use of they and their, this application uses the gender-neutral pronoun gne and the possessive gnes.

Or.

Unless explicit to the contrary, the word "or" should be interpreted as an inclusive or rather than an exclusive or. Thus, the default meaning of or should be the same as the more awkward and/or.

Set.

Unless explicit to the contrary, the word "set" should be interpreted as a group of one or more items.

Step.

The term step may be used in descriptions within this disclosure. For purposes of clarity, one distinct act or step may be discussed before beginning the discussion of another distinct act or step. The term step should not be interpreted as implying any particular order among or between various steps disclosed unless the specific order of individual steps is expressly indicated.

Substantially.

Frequently, when describing an industrial process it is useful to note that a given parameter is substantially met. Examples may be substantially parallel, substantially perpendicular, substantially uniform, and substantially flat. In this context, substantially X means that for purposes of this industrial process it is X. So something that may not be absolutely parallel but is for all practical purposes parallel, is substantially parallel. Likewise, mixed air that has substantially uniform temperature would have temperature deviations that were inconsequential for that industrial process.

As recognized in C. E. Equipment Co. v. United States, 13 U.S.P.Q.2d 1363, 1368 (Cl. Ct. 1989), the word "substantially" in patent claims gives rise to some definitional leeway—thus the word "substantially" may prevent avoidance of infringement by minor changes that do not affect the results sought to be accomplished.

SUMMARY OF THE DISCLOSURE

Aspects of the teachings contained within this disclosure are addressed in the claims submitted with this application upon filing. Rather than adding redundant restatements of the contents of the claims, these claims should be considered incorporated by reference into this summary.

This summary is meant to provide an introduction to the concepts that are disclosed within the specification without being an exhaustive list of the many teachings and variations upon those teachings that are provided in the extended discussion within this disclosure. Thus, the contents of this summary should not be used to limit the scope of the claims that follow.

Inventive concepts are illustrated in a series of examples, some examples showing more than one inventive concept. Individual inventive concepts can be implemented without implementing all details provided in a particular example. It is not necessary to provide examples of every possible combination of the inventive concepts provide below as one of skill in the art will recognize that inventive concepts illustrated in various examples can be combined together in order to address a specific application.

Some aspects of the teachings of the present disclosure may be expressed as a process for monitoring performance of at least one mode of an HVAC system, the process comprising periodically storing a temperature representative of ambient air temperature in a portion of a building treated by the HVAC system.

The process further comprising:

after detection that the HVAC system is in heat mode, create a heat performance tuple that includes:

a heat ΔT value that equals a difference in temperature between a thermostat set point for the HVAC system in heat mode and a value representative of an air temperature outside the building;

a runtime percentage based on a percentage of a set of stored temperatures representative of ambient air temperature in the portion of the building treated by the HVAC system that indicate the HVAC system is in heat mode taken compared with a total number of stored temperatures representative of ambient air temperature in the portion of the building treated by the HVAC system, the runtime percentage taken over a lookback period that ends with an end of a most recent heat runtime;

storing the heat performance tuple along with a date and a time for the end of the most recent heat runtime.

The process also comprising:

after detection that the HVAC system is in cool mode, create a cool performance tuple that includes:

a cool ΔT value that equals a difference in temperature between a value representative of an air temperature outside the building and a thermostat set point for the HVAC system in cool mode;

a runtime percentage based on a percentage of a set of stored temperatures representative of ambient air temperature in the portion of the building treated by the HVAC system that indicate the HVAC system is operating in cool mode taken compared with a total number of stored temperatures representative of ambient air temperature in the portion of the building treated by the HVAC system, the runtime percentage taken over a lookback period that ends with an end of the most recent cool runtime; and storing the cool performance tuple along with a date and time for the end of the most recent cool runtime.

Other aspects of the teachings of the present disclosure may be expressed as a process for monitoring performance of at least one mode of an HVAC system using information from a thermostat for that HVAC system, the process comprising:

periodically storing in memory, information that includes:

current mode of operation for the HVAC system;

whether the HVAC system is active or idle

The process also including:

upon detection that the HVAC system has completed a runtime in heat mode, create a heat performance tuple that includes:

a heat ΔT value that equals a difference in temperature between a thermostat set point for the HVAC system in heat mode and a value representative of an air temperature outside a building that the HVAC system is servicing;

a runtime percentage based on the percentage of the stored values that indicate that the HVAC system was active taken over a lookback period that ends with an end of a most recent heat runtime;

storing the heat performance tuple along with a date and a time for the end of the most recent heat runtime.

The process also including:

upon detection that the HVAC system is running in cool mode, create a cool performance tuple that includes:

a cool ΔT value that equals a difference in temperature between a value representative of an air temperature outside the building and a thermostat set point for the HVAC system in cool mode;

a runtime percentage based on the percentage of the stored values that indicate that the HVAC system was active taken over a lookback period that ends with an end of the most recent cool runtime; and storing the cool performance tuple along with a date and time for the end of the most cool recent runtime.

Still other aspects of the teachings of the present disclosure may be expressed as a monitoring device for monitoring a heat performance of an HVAC system, the monitoring device comprising:

a processor for executing instructions and moving information from one component to another component;

a memory for storing instructions for execution by the processor and for storing data;

a temperature sensor for measuring an air temperature at the monitoring device;

a means for obtaining an outdoor air temperature for air outside of a building containing the monitoring device;

a means for communicating to an Internet connected storage location;

The monitoring device having instructions to enable the monitoring device to:

periodically store the air temperature provided by the temperature sensor;

detect that a most recently obtained air temperature is higher than a set of at least one recently stored air temperatures and deeming that to be an indication that the HVAC heat system is on;

detect that the most recently obtained air temperature is not higher than a set of at least one recently stored air temperatures and deeming that to be an indication that the HVAC heat system is idle;

after detecting that the HVAC heat system became idle after a period of time when the HVAC heat system was on, create a heat performance tuple that includes:

a heat ΔT value that equals a difference in temperature between a temperature where the HVAC system became idle after being on and a value representative of an air temperature outside the building;

a runtime percentage based on the percentage of the obtained temperatures that indicated that the HVAC heat system was on over a lookback period that ends a most recent instance of the HVAC heat system becoming idle after a period of time when the HVAC heat system was on; and storing the heat performance tuple along with a date and time for the most recent instance of the HVAC heat system becoming idle after a period of time when the HVAC heat system was on.

The text set forth above has introduced some of the teachings of the present disclosure but there are many variations. Hence, other systems, methods, features and advantages of the disclosed teachings will be immediately apparent or will become apparent to one with skill in the art upon examination of the following figures and detailed description. It is intended that all such additional systems, methods, features and advantages be included within the scope of and be protected by the accompanying claims.

BRIEF DESCRIPTION OF THE FIGURES

The disclosure can be better understood with reference to the following figures. The components in the figures are not necessarily to scale, emphasis instead being placed upon illustrating the principles of the disclosure. Moreover, in the figures, like reference numerals designate corresponding parts throughout the different views.

DETAILED DESCRIPTION

Figure 1:
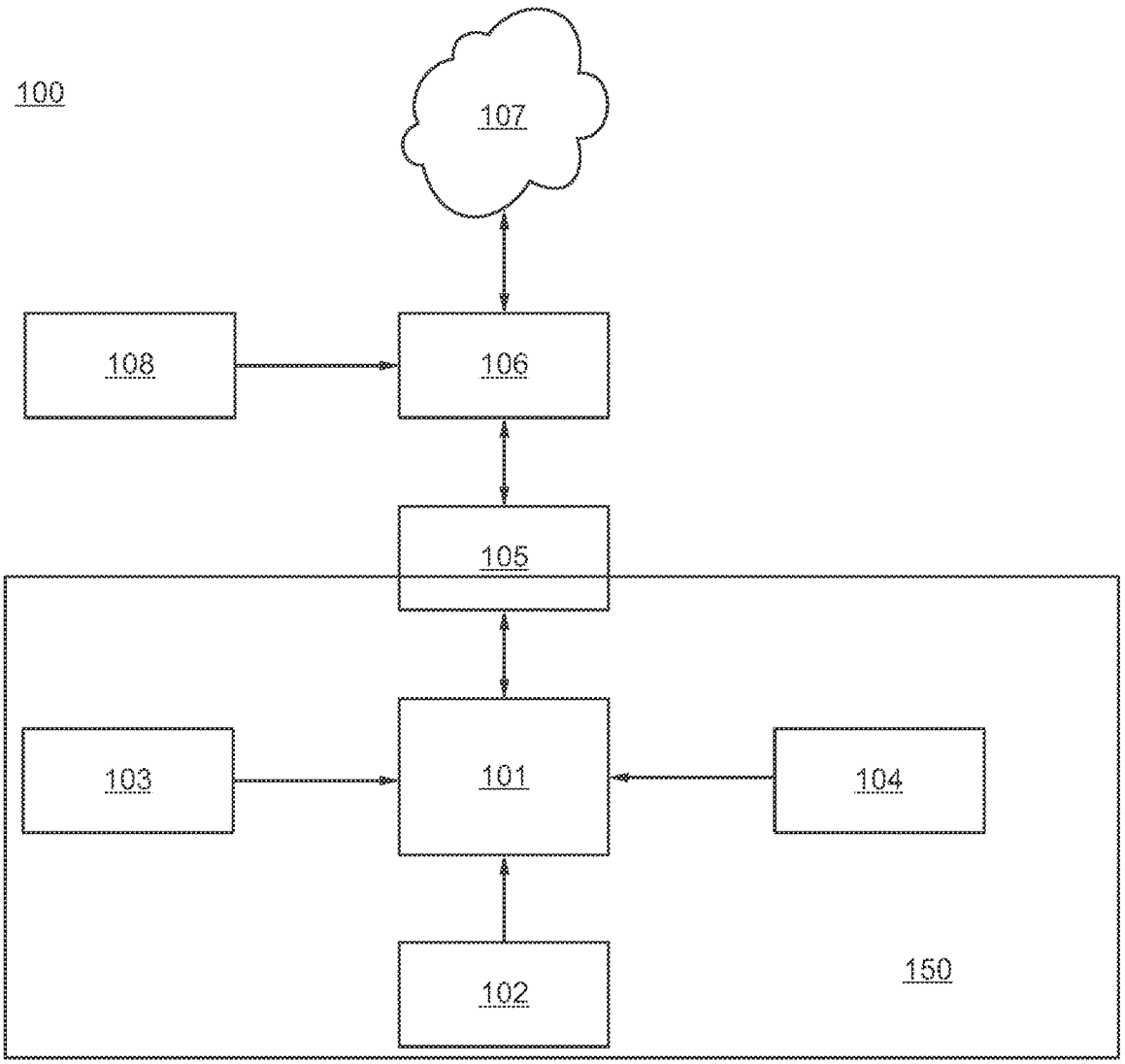
FIG. 1 is a block flow diagram showing various components of the HVAC monitoring unit and system operations.

The presently disclosed subject matter is described with specificity to meet statutory requirements. However, the description itself is not intended to limit the scope of this patent. Rather, the inventors have contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly described.

The present disclosure teaches an apparatus and method for monitoring the performance of a HVAC system by continuously sensing and measuring certain aspects of the environment inside the home, comparing the measurements from inside the home to certain aspects of the environment outside the home, and determining how hard the HVAC system has to work to maintain a comfortable environment inside the home.

The disclosed method and apparatus do not require a physical connection or a communication link with the either thermostat or the HVAC system's controls.

The disclosed solution overcomes the problems of prior art monitoring systems by:

directly measuring the indoor temperature and the indoor humidity of the conditioned space; and obtaining outdoor temperature and outdoor humidity.

The outdoor temperature and outdoor humidity may be obtained from:

a local wired or wireless outdoor sensor;

one of the widely available sources that publish weather information on the Internet based on local ZIP code or other geographic information such as longitude and latitude (accessible from mapping applications).

First Embodiment

One embodiment of a monitoring device in accordance with this disclosure would consist of a monitoring device having:

an indoor temperature sensor;

an indoor humidity sensor, an ability to read and interpret the sensors;

an ability to receive local outside temperature information and other weather-related data such as outdoor humidity, heat index, wind chill, wind speed, wind direction, cloud cover, and other data that could help "fine tune" calculations to determine heat load on the home;

an ability to communicate to the user of the particular HVAC system and the HVAC contractor handling that HVAC unit.

Optionally, performance data can also be stored over a long time period so that year-to-year performance can be compared to get a better picture of how the HVAC system is operating, and if repair or replacement is warranted. Those of skill in the art will appreciate that the long-term storage could be on the local monitoring device, or in a location off the local monitoring device but accessible via communication link from the local monitoring device.

Second Embodiment

A second embodiment would include at least two monitoring devices similar to that described for the first embodiment. The monitoring devices would be placed in different homes or apartments each communicating via Wi-Fi or other wireless communication protocol with a gateway device using a wireless or wired protocol or a cellular solution like NB-IoT. One of skill in the art will appreciate that one could use powerline carrier to connect multiple devices on a single electrical network. The gateway enabling each monitoring device to connect to the Internet and send the gathered information in a format such that it can be accessed by any of the user, HVAC contractor, or property manager.

Indoor Temperature Sensor.

If the monitoring device is not in communication with the thermostat or the HVAC control system, then the monitoring device cannot ask those pieces of equipment what is the current operating mode of the HVAC equipment. The HVAC mode needs to be discerned by the monitoring device based upon the information available to the monitoring device. One of the pieces of information comes from the indoor temperature sensor.

The indoor temperature sensor records the signature or graphed pattern of the HVAC system's cycle times. This temperature signature shows a "saw tooth" pattern as the temperature increases and decreases as the HVAC system operates within its range. When the difference (ΔT) between the indoor and outdoor temperature is large (10° F. or more) it is usually obvious which mode (Heat or Cool) the system is in.

At a lower ΔT this becomes less obvious. A system could easily be set to Cool even when the outside temperature is 65° F. because of heat or humidity buildup inside the home. Conversely, a system could easily be set to Heat even if the outside temperature 75° F. because the home may be cooler inside. Those of skill in the art recognize that there is often a lag between the temperature inside a building and the temperature outdoors. A building may heat up in the morning slower than the outside air warms. Conversely, a building may retain heat into the evening after the temperature has started to drop after sundown.

Thus, especially when the ΔT is low, using indoor and outdoor temperature information is not enough to accurately determine what mode the HVAC system is in.

Indoor Humidity Sensor.

Adding an indoor humidity sensor can overcome the inability to accurately determine what mode the HVAC system is in. The indoor humidity sensor also records the signature of the HVAC system's cycle times. This humidity signature also shows a "saw tooth" pattern, but it differs from the temperature pattern in a significant way. When the HVAC system comes on the humidity in the home always decreases while the system is running. HVAC system mode can therefore be determined by comparing the "saw tooth" signatures of the temperature and humidity sensors. If the humidity is decreasing while the temperature is increasing, the HVAC system is set to Heat. Conversely, if the humidity is decreasing while the temperature is also decreasing, the HVAC system is set to Cool.

One of skill in the art will appreciate that the humidity sensor may read absolute humidity or relative humidity. Both values will trend downward when the HVAC is treating the air so either type of humidity measurement may be used.

Performance Measurement Once HVAC Mode is Known.

Once the correct mode of the HVAC system has been determined, the performance of the HVAC system in that mode may be calculated. One input to calculate the performance of the HVAC system in that mode is the percentage of time that the HVAC is operating during a lookback window. The lookback window is often one or two hours but does not have to be an integer multiple of hours. For example, one may choose to use an interval of 100 minutes.

As the monitoring device is not in communication with the thermostat or the HVAC control system, the monitoring device needs to approximate when the HVAC system is running. In Cool mode, HVAC runtime percentage can be approximated as the percentage of measurements in the lookback window when the current measurement is less than the immediately prior measurement. If 46 of 100 measurements taken within a two-hour lookback window were lower than the immediately prior measurement, then the runtime percentage would be 46%.

Those of skill in the art will appreciate that this process will sometimes have a measurement of indoor temperature that is not less than the immediately prior temperature reading even while the system is on cooling. For example, turning on a ceiling fan in a room with a cathedral ceiling might bring warm air down from the high ceiling space and that might result in a reading or two that is not lower the earlier readings. Similarly, having an open door to bring in groceries in the winter may lead to some instances where an indoor temperature reading is not higher than the preceding reading while the HVAC is heating the room. These anomalies will be infrequent and not impair detection of a degradation of a HVAC system or the general comparison of this system and other similar systems.

Those of skill in the art will appreciate that there may be a lag such that the monitoring device does not immediately discern a drop of room temperature when the HVAC system starts to cool the house. Conversely, the monitoring device may continue to see a drop in temperature for a short time after the HVAC unit has turned off as the impact of previously delivered cool air may take some time to cool the air around the monitoring device.

Likewise, the HVAC running time while in Heat mode this can be approximated by the number of minutes the measured indoor temperature increases.

EXAMPLE

For an HVAC unit in COOL mode, the HVAC unit turns on at 10 a.m. and the monitoring device discerns the start of a runtime to COOL by sensing a drop in temperature and confirming that this is from the HVAC system by seeing that there was also a drop in humidity. Particularly for systems with frequent measurements, it can be helpful to compare the current measurement to either an average of the last several measurements or to compare the current measurement with a measurement from two or three measurements ago rather than the immediately preceding measurement as that will tend to highlight a new change in direction.

The HVAC system runs 15 minutes to cool the temperature down two degrees from 72 degrees to the thermostat setting of 70 degrees and turns off. The monitoring device discerns that the temperature bottomed out at 70 degrees and is now slowly rising so this marks the end of the most recent runtime. The monitoring device looks that the stored data to determine the runtime percentage of the HVAC unit over the lookback window. A lookback window of two-hours has been found useful for generating data with little noise. Using a lookback window of two-hours the monitoring device would note the percentage of runtime from 815 a.m. to 10:15 a.m. (the end of the runtime). The HVAC unit would note the temperature at the end of the runtime—70 degrees and obtain a representative temperature for 10:15 a.m. at that location. With the two temperatures, a ΔT value can be calculated. The data record for this runtime would thus be: {Jul. 23, 2021, 10:15 a.m., Mode-COOL, ΔT of X degrees, runtime percentage Y}.

The HVAC system remains idle until 10:35 a.m. At 10:35 a.m. the HVAC system begins to cool the house again. The monitoring system detects the drop of humidity and temperature and begins another cooling runtime. At 10:50 a.m., the HVAC thermostat measures 70 degrees and stops the cooling. The monitoring device notes that the temperature bottomed at 70 degrees and is now rising. This marks the end of the current runtime.

Using the same two-hour lookback window as before the monitoring device would note the percentage of runtime from 850 a.m. to 10:50 a.m. (the end of the runtime). The HVAC unit would note the temperature at the end of the runtime—70 degrees and obtain a representative temperature for 10:50 a.m. at that location. With the two temperatures, a ΔT value can be calculated. The data record for this runtime would thus be: {Jul. 23, 2021, 10:50 a.m., Mode-COOL, ΔT of XX degrees, runtime percentage YY}.

One of skill in the art will appreciate that an individual runtime will impact several calculations of runtime percentage as recent runtimes are within the two-hour lookback window. One of skill in the art will appreciate that some third-party weather data sources may only update data every 15 minutes or so. Thus, in some instances the query for current outdoor temperature to the third-party weather data source will provide the most recent value and not necessarily the true contemporaneous value.

Once the performance values are being collected, the monitoring device can then track the performance of the HVAC system over a period of months and even years and alert the homeowner as the performance deteriorates.

These features overcome the problems inherent in previous HVAC performance monitors and enable contractors to maintain their customers' equipment at optimum levels. Timely warning of performance drop offs which may indicate a deteriorating HVAC system allows homeowners to save money on energy and repair bills.

FIG. 1.

An HVAC monitoring system 100 in accordance with one embodiment of the invention is illustrated in the block diagram shown in FIG. 1. This illustrative HVAC monitoring system 100 has seven basic units.

First, a processor 101. This may be a central processing unit (CPU). The preferred embodiment of the processor 101 contains a microprocessor with memory for analyzing and storing input readings and is located inside the home or building to be monitored. The processor 101 may be comprised of other suitable electrical and/or mechanical means necessary to monitor and process input data. Such processing means may take the form of a central processing unit or variant microelectronic circuitry. This particular disclosure does not care if the hardware and software necessary to perform the various tasks uses a general-purpose processer, an ASIC, a PLD, or some other device. The instructions may be stored in memory and the memory may be read only memory or in memory that may be updated.

The input elements to the processor 101 may include an analog-to-digital (A/D) converter that converts analog ambient environmental readings inside the home and converts them to digital outputs readable by the processor 101, or it may use sensors with a digital output that communicates with the processor 101 using a common digital interface like I2C. These readings are supplied by a temperature sensor 103, and a humidity sensor 102. The processor 101 is also linked to the home Wi-Fi network 105 which is in turn connected to the Internet 106 which enables the processor 101 to access a remote database server, or cloud 107 to acquire the local outdoor temperature from the local outdoor weather data 108. One of skill in the art will appreciate that the use of the wireless Wi-Fi network 105 may be replaced with a hardwired connection (not shown).

In many instances several components from FIG. 1 will be housed within one device—the monitoring device 150. The monitoring device 150 may include:

Processor 101

Humidity Sensor 102

Temperature Sensor 103

Memory 104

A portion of the Wi-Fi network 105. As there will need to be a transceiver associated with the monitoring device 150 and one or more transceivers associated with the home Wi-Fi network, the box for the Wi-Fi network 105 is shown as only partially within monitoring device 150.

Those of skill in the art will appreciate that there are advantages to having all the relevant components of the monitoring device 150 within one housing, a designer could implement the monitoring device 150 in two or more housings that are connected via hardwire connection or short-range wireless connection.

Likewise the tasks assigned to the processor 101 could be allocated to a set of two or more devices that collectively accomplish the tasks of the processor 101. Coprocessors are well known in the art and may be used for I/O interfacing, math processing, or other tasks. There may be two or more processors that are the same type but are working collectively to accomplish the tasks assigned to the processor 101.

FIG. 2.

Figure 2:
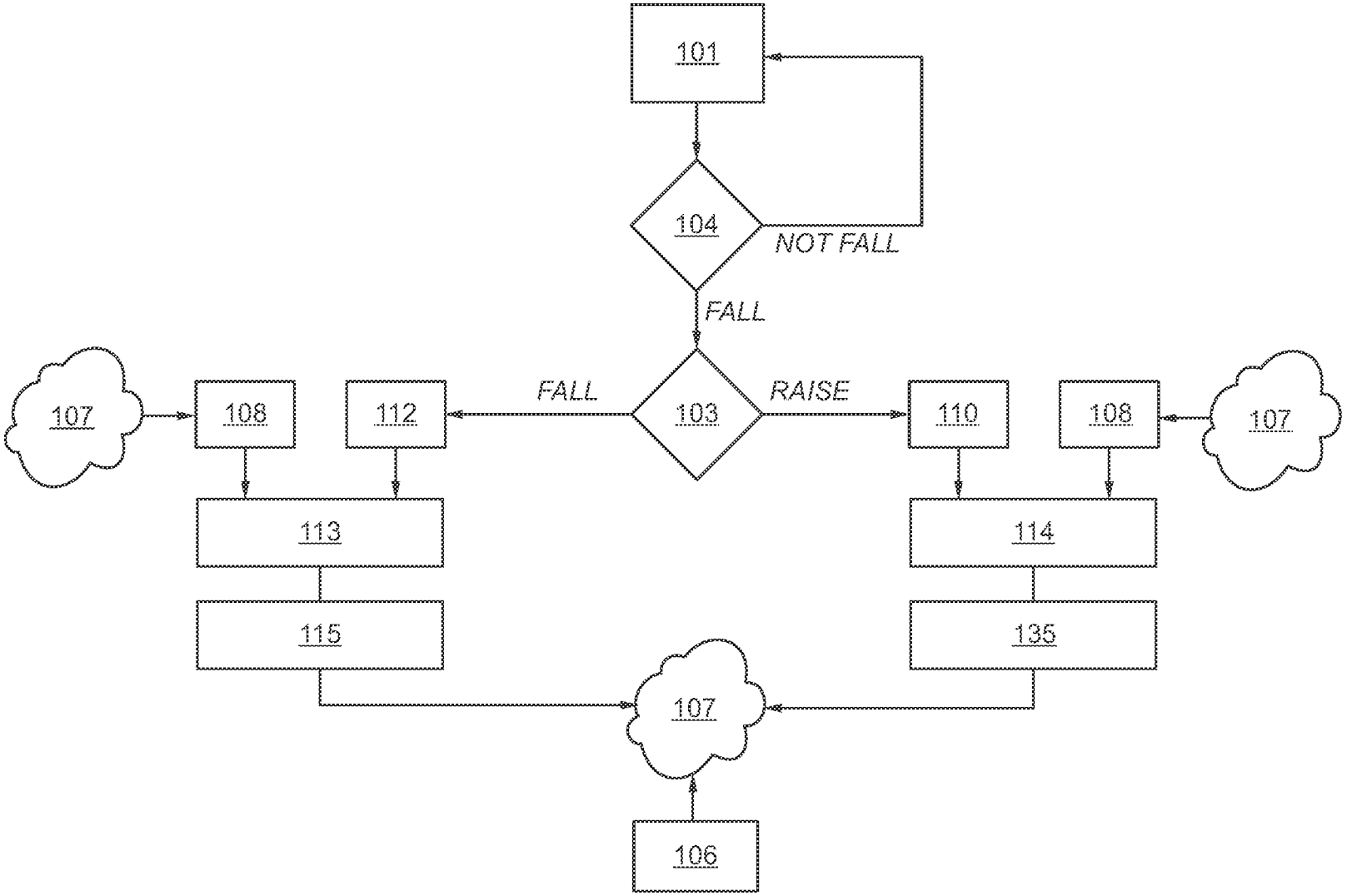
FIG. 2 is a block flow diagram showing the operations of the HVAC monitoring unit during normal operating conditions.

The operation of the monitoring device 100 is shown in the block flow diagram FIG. 2. The processor 101 continuously reads the results from the temperature sensor 103 and stores them in memory. For example, the processor 101 may collect and store fifty indoor temperature readings per hour. The processor 101 also continuously reads the results from the humidity sensor 102. If the newest humidity reading is the same or greater than the previous reading the processor 101 awaits the next reading.

The processor 101 will repeat reading the humidity sensor 102 until the reading indicates a trend towards lower humidity than before. On reading a movement to a lower humidity, the processor 101 proceeds to read the temperature values stored in memory to discern whether the system is in Heat mode or Cool mode. One of skill in the art will recognize that a designer may choose to compare the most current temperature against the immediate prior temperature or may take an average of two or more recent but prior temperatures for the comparison. A system that samples temperature very frequently may benefit from using a range or recent temperatures as the temperature difference with a temperature reading taking a tiny amount earlier may not give a clear indication. Fortunately, the HVAC system begins to effect temperature before humidity so that once humidity drops, the direction of temperature movement should be clear.

One of skill in the art will appreciate that the system could be set to detect a change in temperature and then check for a downward change in humidity to confirm an active HVAC system just as easily as the sequence shown in FIG. 2 which looks for a downward change in humidity and then looks for the trend in temperature.

Performance of a Heating System.

During a time period when the relative humidity is dropping, a temperature rise over time would indicate the home HVAC system is calling for heat 110. Before calculating ΔT, the processor 101 then accesses current local outdoor weather data 108 from the Cloud 107 through the home Wi-Fi network 105, and calculates the heat runtime percentage 114 of the HVAC system. In this case, the runtime percentage is the percent of temperature measurements over the lookback window where the measurement is warmer than the immediate prior measurement.

Comparing the heat runtime to the difference between the outdoor temperature gleaned from Internet data set with outdoor weather data 108 to the indoor temperature measured at temperature sensor 103 (Heat ΔT) yields the heat system performance 135. The heat system performance 135 is actually a tuple. One can think of it as a 3-tuple (Mode, runtime %, ΔT) or one can think of it as a 2-tuple (runtime %, ΔT) with the heating tuples stored separately from the cooling tuples. One of skill in the art will appreciate that instead of ΔT values, the stored information could be the indoor temperature and the outdoor temperature such that the ΔT could be calculated from the stored data. Alternatively, the ΔT value and the temperature values may be store. The stored material may be stored in the cloud 107 for future reference.

Performance of a Cooling System.

A temperature decrease in the current temperature reading versus the most recent temperature reading would indicate the home HVAC system is calling for cool 112. The processor 101, then accesses current local outdoor weather data 108 from the Cloud 107 through the home Wi-Fi network 105, and calculates the Cool Runtime percentage 113 for the home.

The Cool Runtime percentage 113 is the percent of temperature readings in the lookback period that are lower than the immediately prior reading. A tuple representing cool system performance tuple 115 may be formed with the ΔT value and percent value. It is a 3-tuple if you include the mode of COOL. The processor 101 then stores at least a relevant portion of the real-time outdoor weather data 108, indoor temperature from temperature sensor 103, and cool system performance 115 for future reference. The storage may be in the cloud 107.

FIG. 3.

Figure 3:
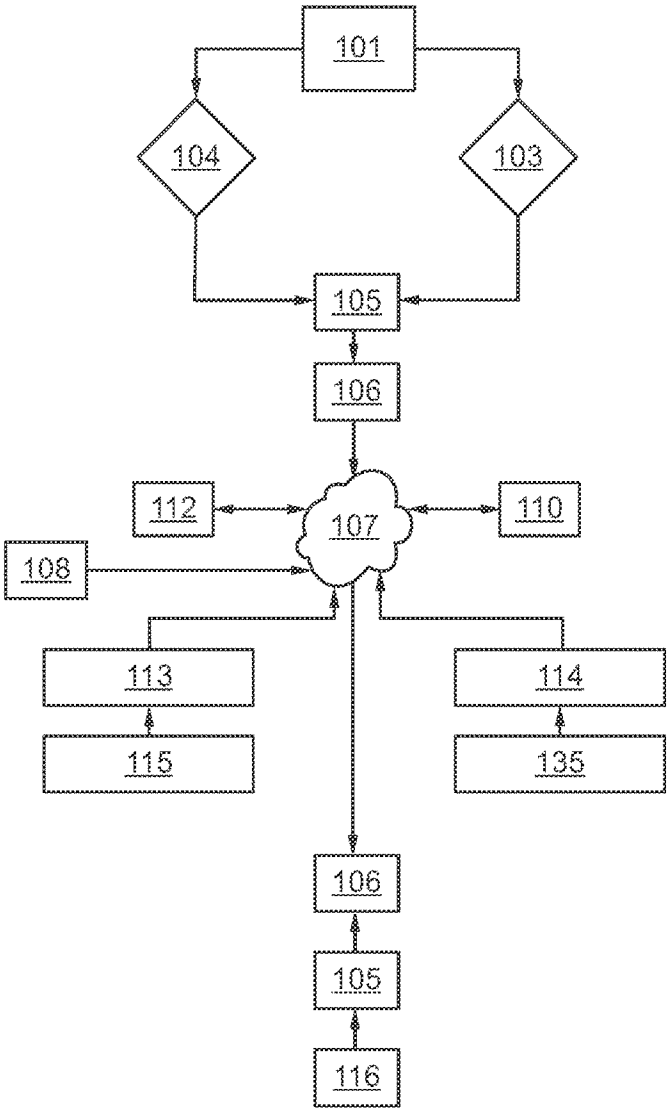
FIG. 3 is a block diagram showing the operation of an alternate embodiment of the HVAC monitoring unit where all the calculations are handled in the cloud.

FIG. 3 shows a block diagram of an alternate embodiment where the mode and performance calculations are done in the cloud 107 instead of the in the processor 101 within the monitoring device 150. The processor 101 sends indoor humidity measured at humidity sensor 102 and indoor temperature measured at temperature sensor 103 information to the cloud 107 via the Internet 106 using the local Wi-Fi network 105. Instructions performed within the cloud 107 analyze this information and determine the mode of the HVAC system, heat 110, cool 112, or idle. Further analysis yields the Heat Runtime percentage 114 or Cool Runtime percentage 113. Additional instructions determine the tuple for cool system performance 115 or the tuple for heat system performance 135 of the HVAC system and store it in the cloud 107 where it can be accessed by the user 116 on the Internet 106. This access may be via Wi-Fi network 105. One of skill in the art will appreciate that a user 116 can access information in the Internet 106 through a variety of communication channels that may not include Wi-Fi network 105 such as a wired connection, or a data connection through a cell phone or some other connection.

FIG. 4.

Figure 4:
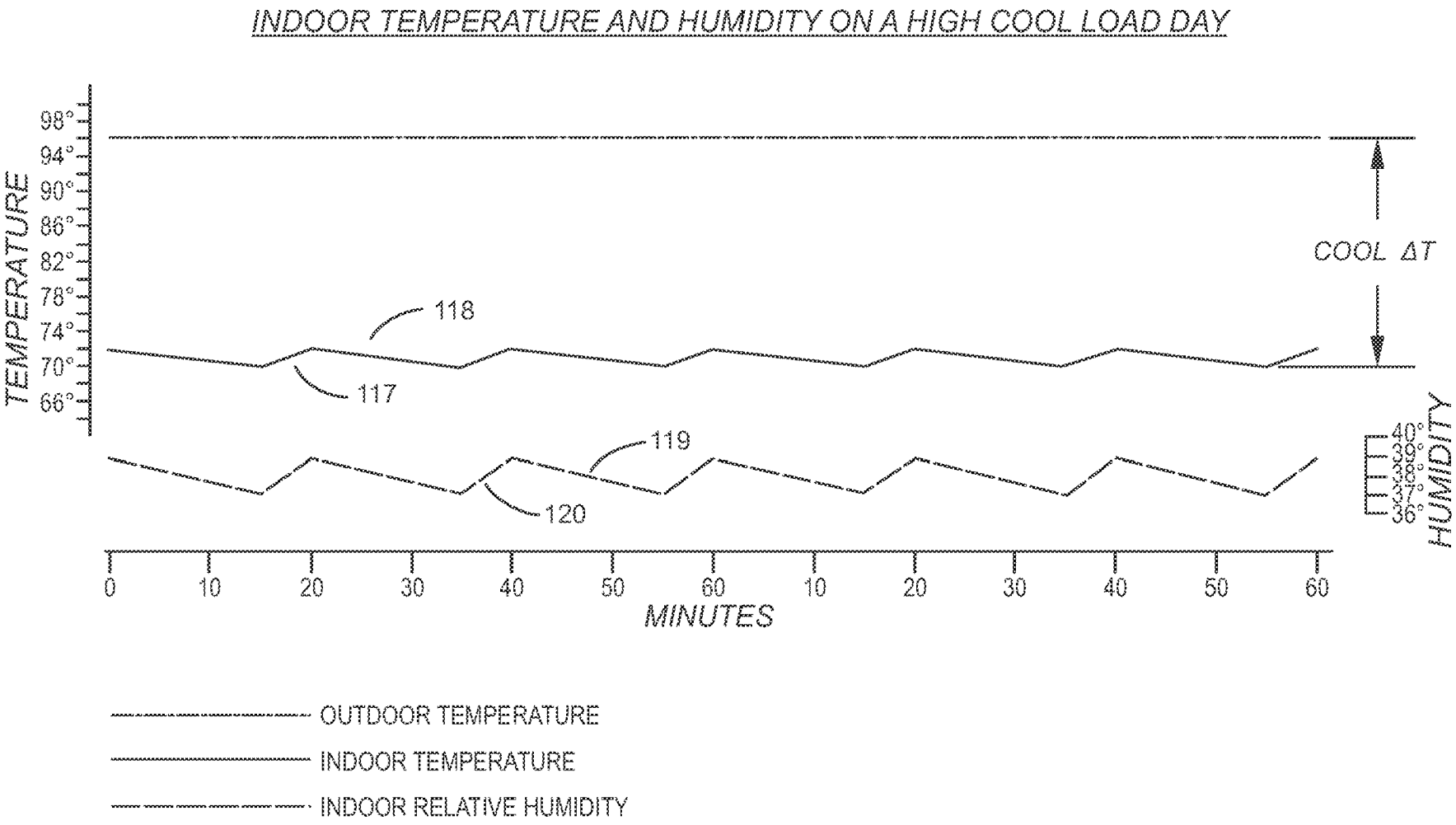
FIG. 4 is a graphic depiction of the relationship between the indoor temperature, the outdoor temperature, and the indoor humidity on a very hot, high load day.

FIG. 4 shows a graphical representation of a two-hour period of a hypothetical, hot, "high load" day with the outdoor temperature at 96° F. The graph of the indoor temperature shows a series of long slow declines 118 indicating a 15-minute time period is required to lower the home's temperature by two degrees. There are six declines 118 in the two-hour period indicating a 45-minute runtime per hour or 75% of the time. As the indoor temperature is declining, the indoor relative humidity also declines 119 indicating that the HVAC system is set to cool. When the indoor temperature reaches 70° F., the HVAC thermostat turns off the cooling. With the cooling off and the outdoor temperature of 96 degrees, the indoor temperature starts to climb again as indicated by upward slope on incline 117.

While the HVAC system is no longer cooling the house, the indoor relative humidity rises as indicated by upward ramp 120 indicating to the monitoring device 100 that the HVAC is idle and the Cool ΔT is 26.

While the difference between the indoor and outdoor temperature will vary as the HVAC system operates, the Cool ΔT for use in calculations is the difference between the outdoor temperature as reported from the source on the Internet and what appears to be the indoor setpoint for the thermostat. In this case, the sawtooth graph notes the air-conditioning has apparently just reached the thermostat set point of 70, and has now turned off the air-conditioning.

At this point, the thermal load on the home causes the indoor temperature to rise as indicated by incline 117. It then takes only 5 minutes for the thermal load on the home to raise the temperature by 2° F. at which point the air-conditioning is started again and the cycle repeats. Note that different thermostats may have different deadband values. Some may respond when the temperature rises 2 degrees above the setpoint. Some may respond at a different range such as 1 degree or 3 degrees. The teachings of the present disclosure do not hinge on the HVAC system using a particular deadband value.

FIG. 5.

Figure 5:
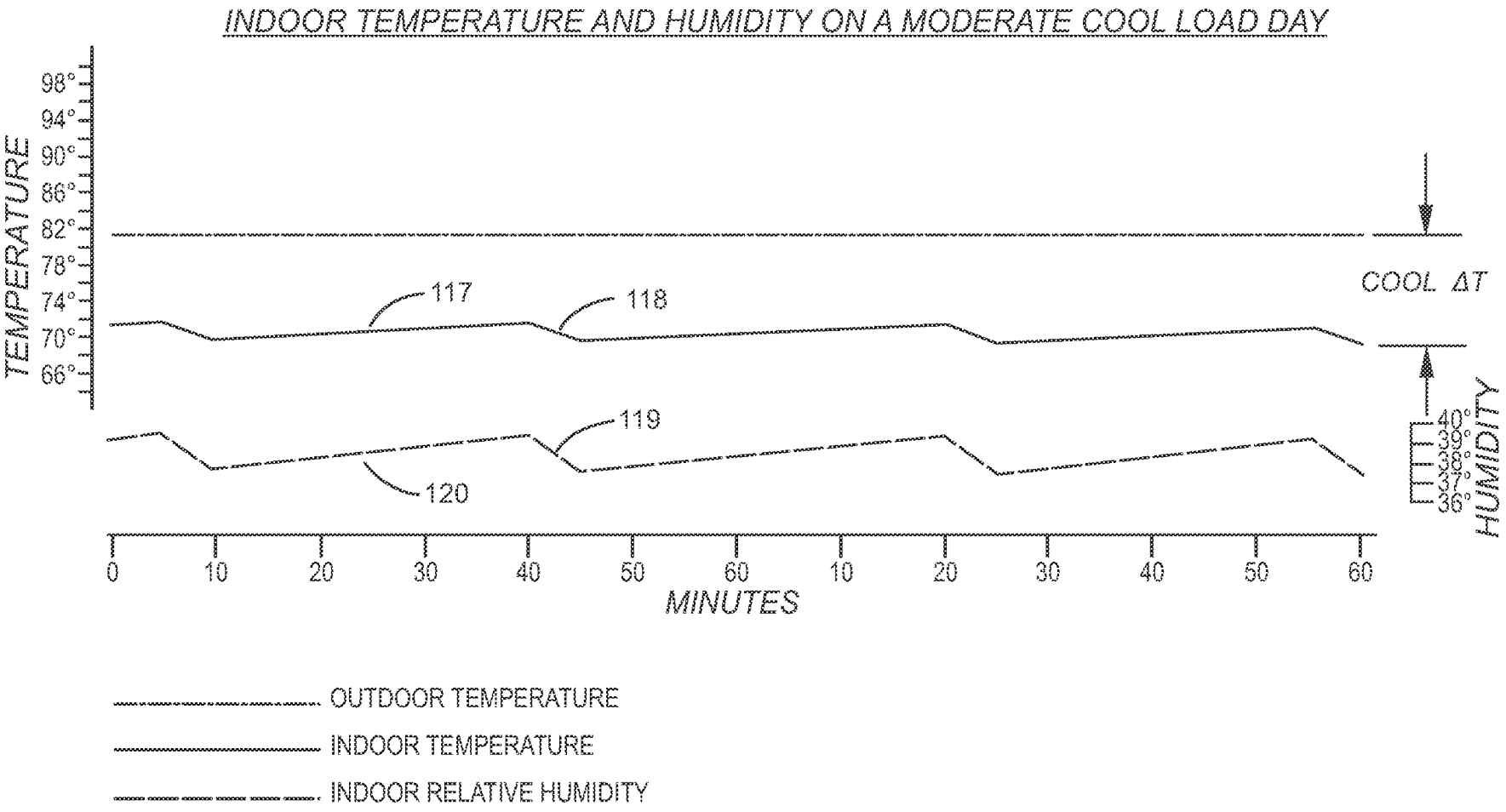
FIG. 5 is a graphic depiction of the relationship between the indoor temperature, the outdoor temperature, and the indoor humidity on a warm, moderate load day.

FIG. 5 shows a graphical representation of a two-hour long period of a hypothetical, warm, "moderate load" day with the outdoor temperature at 82° F. The graph of the indoor temperature shows a decline 118 indicating a 5-minute time period is required to lower the home's temperature by two degrees. Over two hours, there were four five-minute declines for a runtime percentage of 17%. During the temperature decline 118, the indoor humidity also declines 119 indicating that the HVAC system is set to cool. When the indoor temperature reaches 70° F., the temperature starts an incline 117, and the indoor relative humidity starts an upward ramp 120 indicating that the HVAC is idle and the thermostat setpoint is again at 70 degrees as the air-conditioning appears to reach the thermostat set point of 70 degrees and then turn off the air-conditioning. The Cool ΔT is 12 degrees as that is the difference between the Internet value for outside temperature and the apparent set point for the HVAC thermostat. At this point, the thermal load on the home causes the indoor temperature to rise as indicated by incline 117. It then takes 30 minutes for the thermal load on the home to raise the temperature by 2° F. at which point the air-conditioning is started again and the cycle repeats.

FIG. 6.

Figure 6:
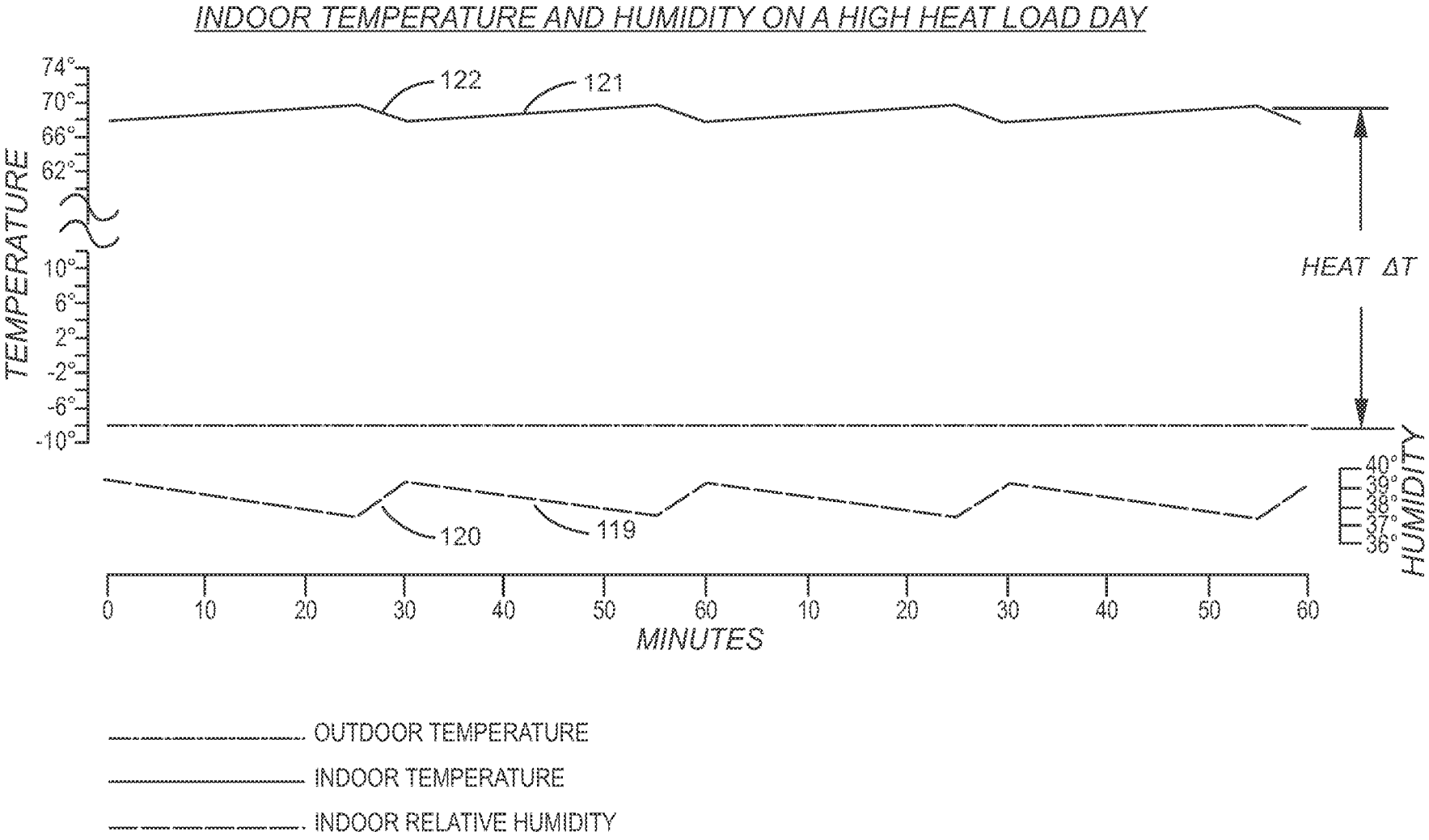
FIG. 6 is a graphic depiction of the relationship between the indoor temperature, the outdoor temperature, and the indoor humidity on a very cold, high load day.

FIG. 6 shows a graphical representation of a two-hour long time period of a hypothetical, cold, "high load" day with the outdoor temperature at −8° F. The graph of the indoor temperature shows a long slow temperature incline 121 indicating a 25-minute time period is required to raise the home's temperature by two degrees. Over a two-hour period the runtime is 100 of 120 minutes, or a furnace runtime percentage of 83.3%. As the indoor temperature is rising, the indoor relative humidity declines on decline 119 indicating that the HVAC system is set to heat. When the indoor temperature reaches 70° F., the temperature starts to drop again 122, and the indoor humidity rises indicating that the system had just reached the thermostat set point of 70 degrees, and has now turned off the furnace. At this point, the thermal load on the home causes the indoor temperature to decline as shown in downward ramp 122. It then takes 5 minutes for the thermal load on the home to lower the temperature by 2° F. at which point the furnace is started again and the cycle repeats.

While the example for FIG. 6 references a furnace, one of skill in the art will recognize that the present disclosure works independently of the manner of applying heat to the home. The heat could be applied using a furnace that drives warmed air into the house. Alternatively, the furnace could be used to drive hot water through pipes that provide radiant heat. The heat could be applied by a heat pump which uses the same system as is used for cooling but pumps heat into the house rather than dumping heat out of the house. Other system including electric strip heat may be used. There is not a requirement that the HVAC system be one unified system. There may be one system for providing cooling and a totally different system for providing heating.

FIG. 7.

Figure 7:
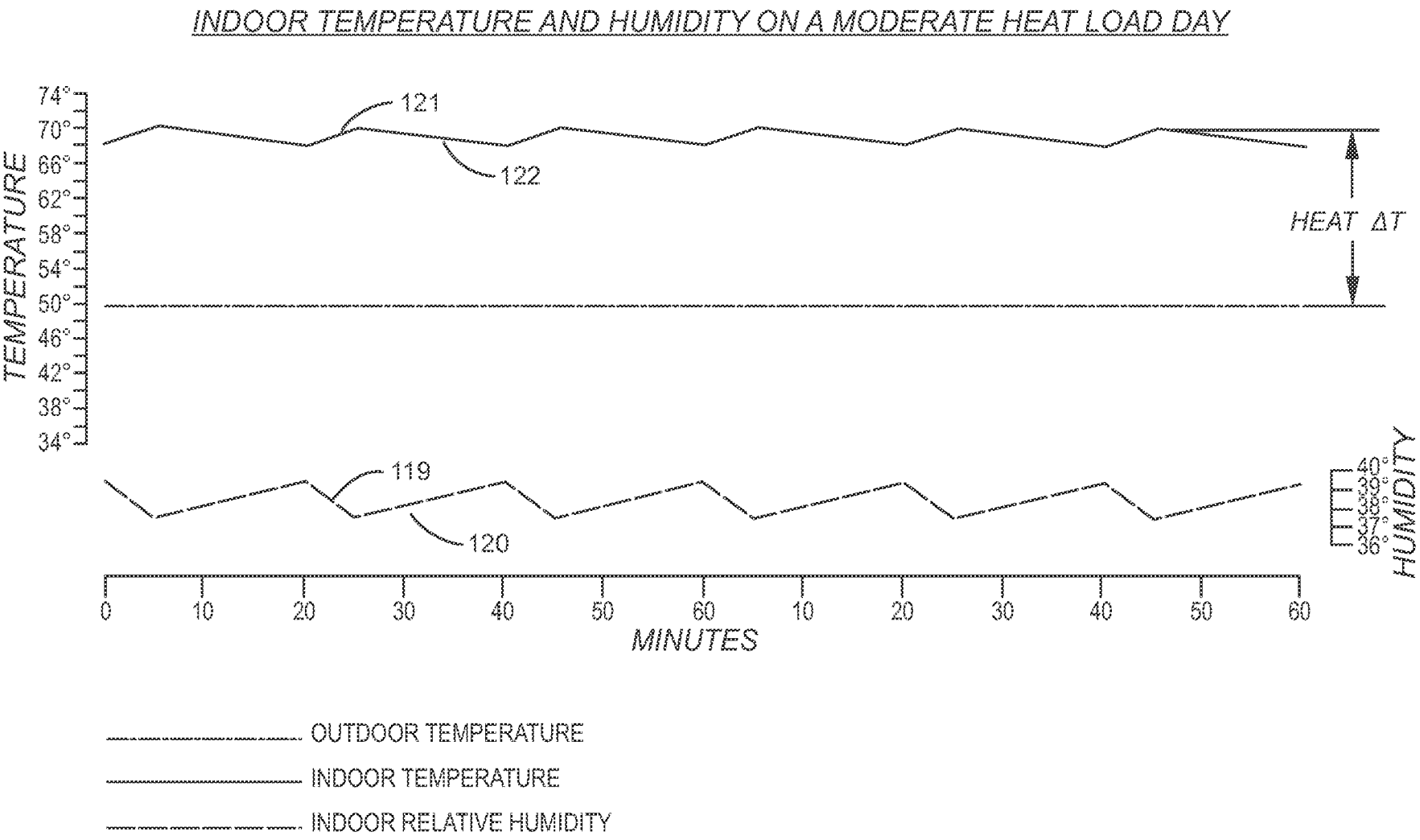
FIG. 7 is a graphic depiction of the relationship between the indoor temperature, the outdoor temperature, and the indoor humidity on a cool, moderate load day.

FIG. 7 shows a graphical representation of a two-hour long time period of a hypothetical, cool, "moderate load" day with the outdoor temperature at 40° F. The graph of the indoor temperature shows a temperature rise on upward ramp 121 indicating a 5-minute time period is required to raise the home's temperature by two degrees. Over the two-hour period there are six periods of 5-minutes each of temperature rise indicating a heat runtime percentage of 25%.

As the indoor temperature is rising, the indoor humidity declines as shown in decline 119 indicating that the HVAC system is set to heat. When the indoor temperature reaches 70° F., the temperature starts to drop again as seen in downward ramp 122, and the indoor relative humidity rises in upward ramp 120 indicating that the system had just reached the thermostat set point, and has now turned off the furnace. At this point, the thermal load on the home causes the indoor temperature to drop as shown in downward ramp 122 as the outdoor temperature is well below the temperature inside. As it is a mild day outside, it then takes fifteen minutes for the thermal load on the home to lower the temperature inside by 2° F. at which point the furnace is started again and the cycle repeats. The cycles of 5 minutes of heating and 15 minutes of time between heat cycles leads to the furnace runtime percentage of 25% as this pattern repeats over the 2-hour window.

Figure 8:
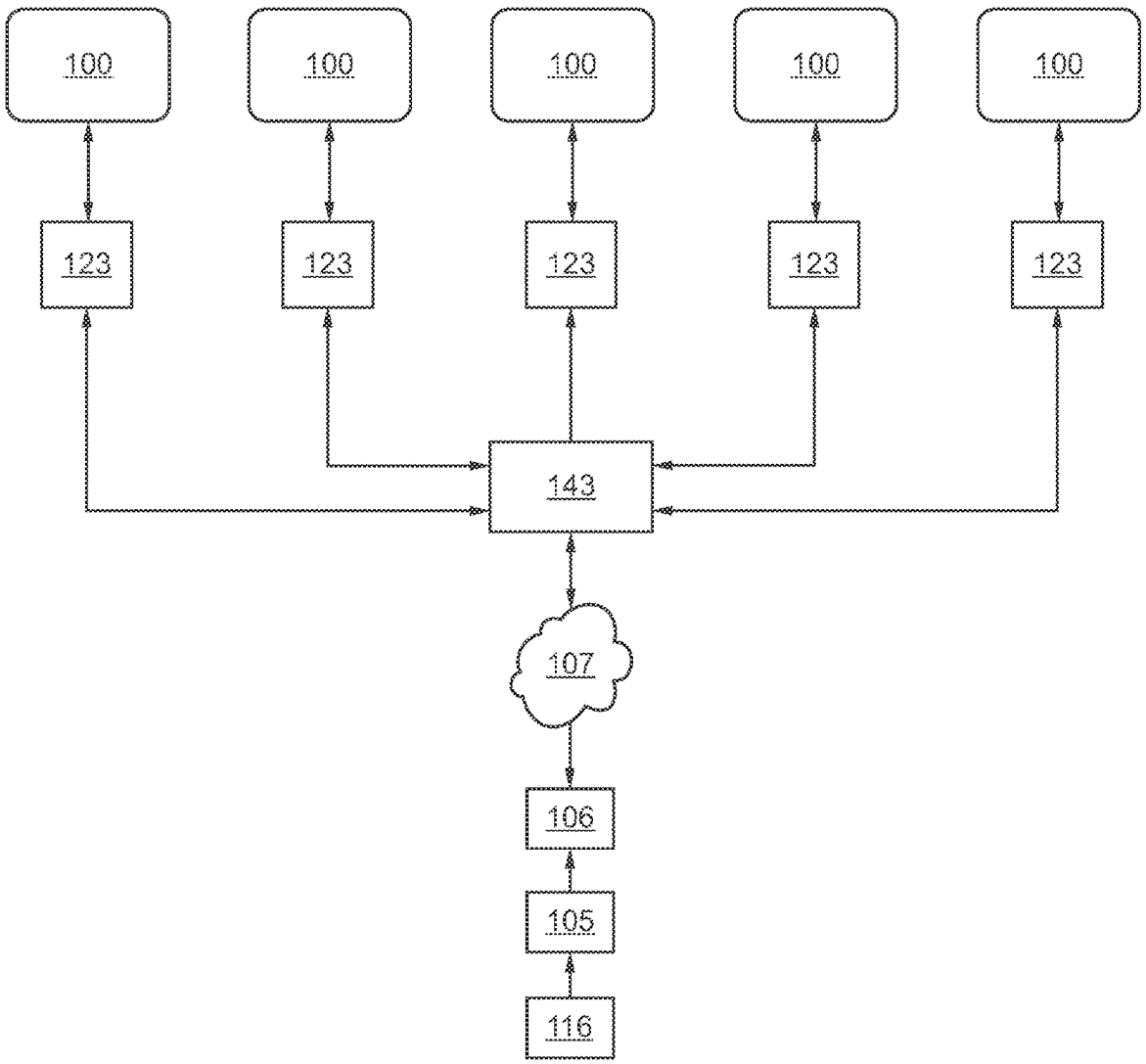
FIG. 8 is a block flow diagram showing multiple monitoring units connected to the Internet using a gateway.

FIG. 8,

FIG. 8 shows a block diagram of multiple monitoring devices 100 connected to a local LP-Wan wireless network such as LoRa 123 which is linked to the cloud 107 via a gateway 143. The cloud 107 can then be accessed via the Internet 106 through a local Wi-Fi network 105 by the user 116.

One of skill in the art will appreciate that this configuration would be well-suited to an apartment complex, condominium, or office condominium where a number of distinct HVAC units linked to their own thermostats are in close proximity such that short range communication protocols may be used to reduce the number of Internet connections. This may have the advantage of having the Internet pathway for monitoring of the HVAC performance be independent of the Wi-Fi and Internet connections of individual tenant/owners of the units in the multi-unit building.

One of skill in the art will appreciate that some larger homes have two or more HVAC units such as different units for different floors or wings of a house. Such a household may find the use of a gateway 143 is preferable to having each of the different monitoring devices 100 having a separate path out to the Internet 106.

FIG. 9.

Figure 9:
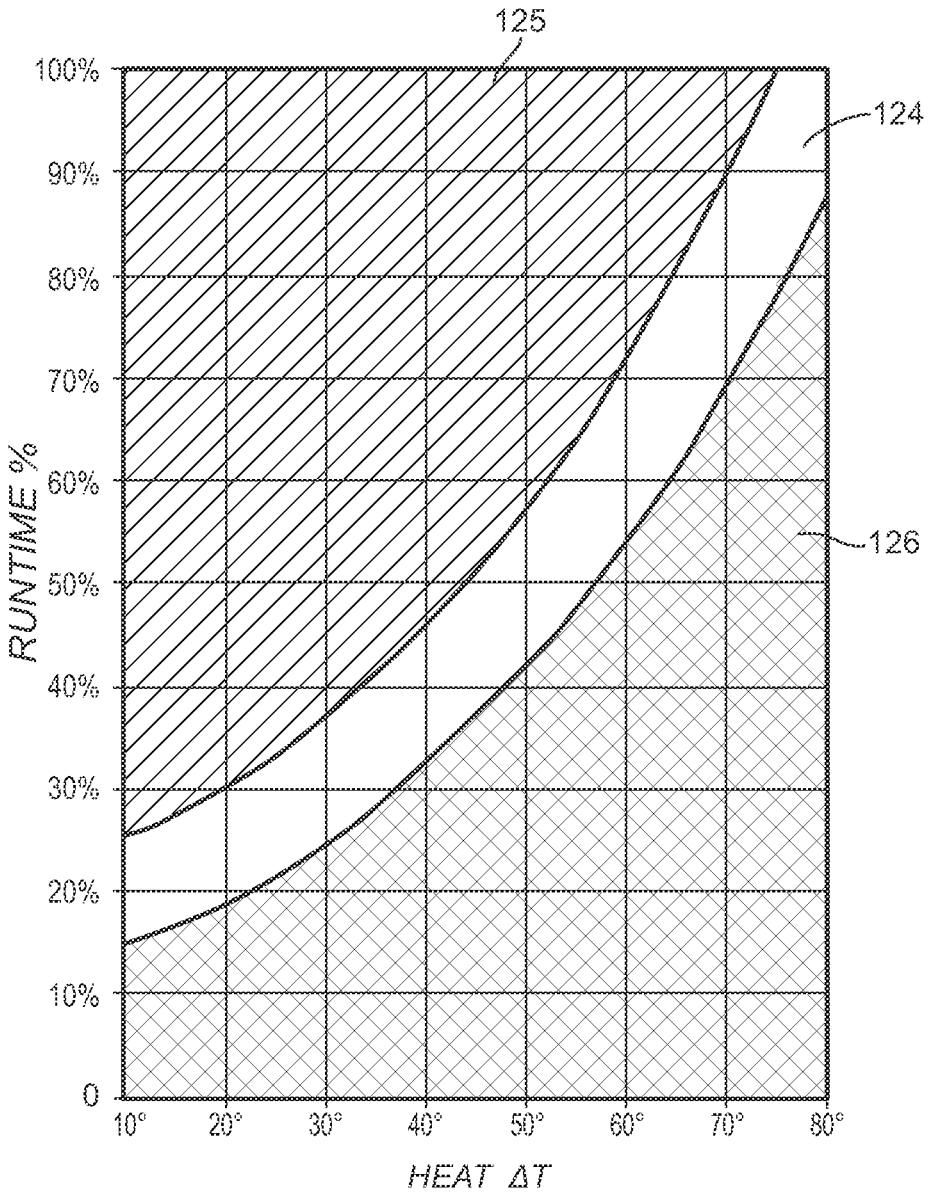
FIG. 9 is a graph showing the relationship between Heat ΔT, Heat Runtime, and Heat Efficiency.

FIG. 9 shows a graph illustrating the relationship between runtime and heat ΔT in a home or conditioned space with the thermostat in heat mode. The area 124 represents normal "good performance" operation, area 125 represents "excellent performance," and area 126 represents "poor performance." One of skill in the art will appreciate that judgement was exercised to deem the various points on the line between area 124 and area 126 to be equivalent in performance. Thus a runtime percentage of 70% at a 70-degree ΔT is deemed equivalent to a runtime percentage of approximately 18% at heat ΔT of 20 degrees. Note that data taken at below 10 degrees of heat ΔT are not even graphed.

One of skill in the art may deem the line between area 124 and area 126 to be an isoline for a particular level of performance. This level of performance may be given a letter grade or an arbitrary performance percentage. The line between area 124 and area 126 may be a consequence of the judgment of the designer or based on empirical evidence that a certain HVAC unit providing heat would tend to follow a curve like this one.

FIG. 10.

Figure 10:
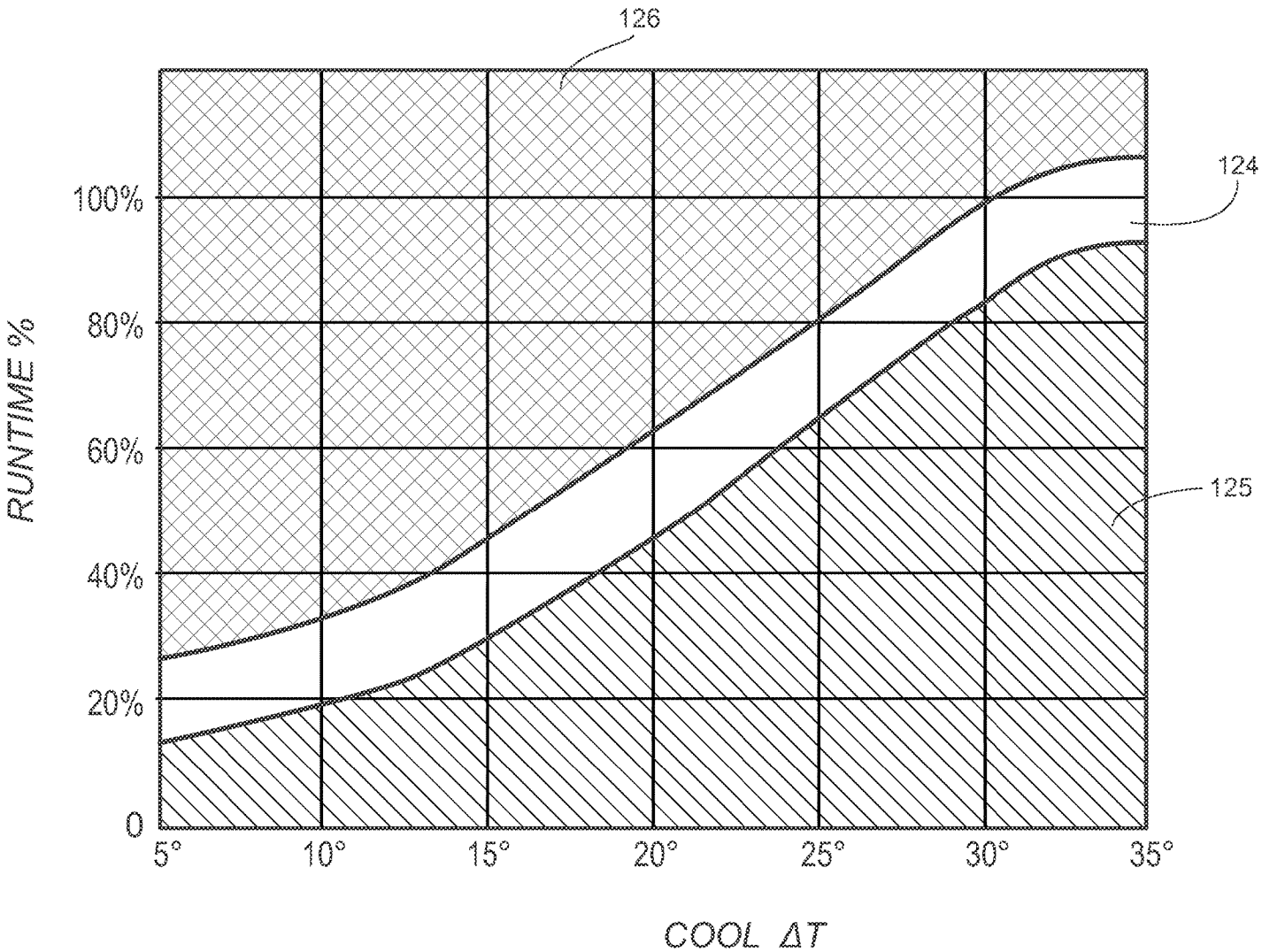
FIG. 10 is a graph showing the relationship between Cool ΔT, Cool Runtime, and Cool Efficiency.

FIG. 10 shows a graph illustrating the relationship between runtime and cool ΔT in a home or other conditioned space with the thermostat in cool mode. The area 124 represents normal "good efficiency" operation, area 125 represents "excellent efficiency," and area 126 represents "poor efficiency."

Preferred Embodiment

The preferred embodiment of the teachings of this disclosure consists of one device including a microprocessor, temperature sensor, a humidity sensor, and a Wi-Fi interface mounted within a housing suitable for placement on a shelf, counter, tabletop, or other location inside a home. The placement of the device should be in a location with good access to the home's Wi-Fi network and ambient temperatures and air flow that is typical of the home. Thus the device should not be placed in direct sunlight or too close to the HVAC vents. For convenience during design, the sensors may be of a type easily interfaced to and readable by the processor.

The processor should have means to amplify and condition the signals sent by the sensors in accordance with instructions furnished by the sensor manufacturer(s). The processor should capable of accessing through a communication link in the monitoring device a local Wi-Fi network. The monitoring device should also be able to store enough sensor data to allow the processor to determine the thermostat mode (COOL, HEAT, IDLE).

The monitoring device may be configured with additional memory and processing power to allow the monitoring device to calculate efficiency calculations within the monitoring device rather than moving those calculations up to the cloud and incurring charges for use of resources in the cloud.

Those of skill in the art will appreciate that power to the monitoring device can be provided from a standard, plug-in, "wall wart" type power supply that can be plugged into any convenient electrical outlet. The form of power supply is beyond the scope of the current disclosure and those of skill in the art can substitute a battery or a solar panel on the device to provide power.

The device can be accessed by the homeowner's cell phone using point to point Wi-Fi settings. This will allow the homeowner to enter the local Wi-Fi network password and the local postal zip code. Once the device has this information it can start monitoring the temperature and humidity in the home. It can also access one of several available weather information sites (API's) and download local outdoor weather information for the local zip code area. Comparing information like local outdoor temperature, humidity, and other data gathered from the Internet with indoor data the device has obtained through its own sensors like indoor temperature and humidity, the device can determine the thermal load on the home as well as the efficiency of the home's HVAC system.

Those of skill in the art will appreciate that through the use of an API, that a location identifier (such as postal code, longitude/latitude, grid ID, or other) and a time value can be used to obtain a set of one or more weather values from a third-party weather information source such as Weather Underground or other similar services. Once the format of the set of returned values is known, it is possible to obtain the relevant outdoor temperature value.

Impact of a Poorly Insulated Home

Those of skill in the art will appreciate that a poorly insulated home with substantial air leakage around doors and windows will require the HVAC system to work more than a home across the street subjected to the same weather. Thus, the runtime percentage as a function of ΔT would be different for two HVAC systems that were performing equally well if one HVAC system was on a well-insulated home and the other HVAC system was on a poorly insulated home.

While the runtime percentages will be different for equally efficient units facing the same thermal loads, that does not undermine the importance of runtime percentage as a function of ΔT. The initial measurements of runtime percentage as a function of ΔT would indicate a sub-optimal situation. Investigation would identify poor insulation and the homeowner would be alerted that this situation will cause higher utility bills. Even if the homeowner does not address the poor insulation issues, the monitoring will still be beneficial as an increase in runtime percentage for a particular ΔT over time will indicate a degradation of performance of the HVAC unit. Thus, often the most relevant comparison is the comparison to data taken at an earlier time for this same house.

Adding Performance Monitoring to a Smart Thermostat.

Figure 11:
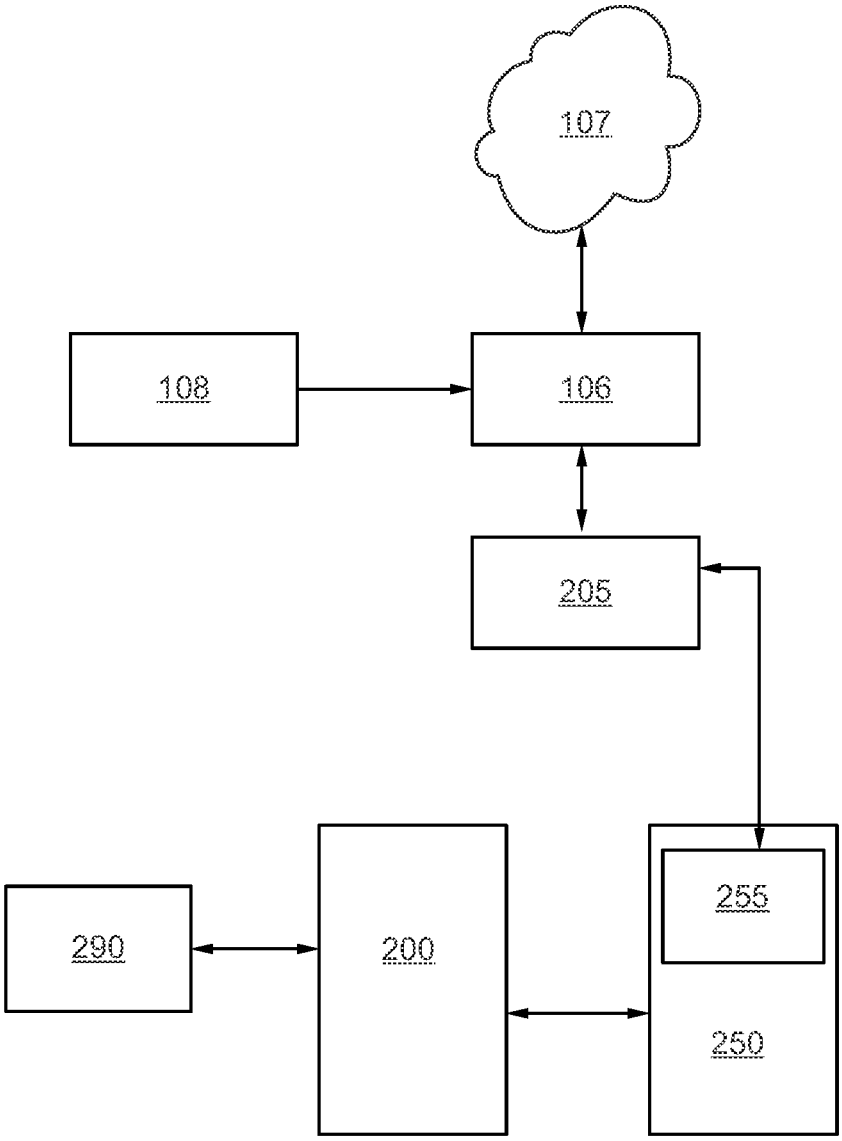
FIG. 11 shows another monitoring system 200 that is integrated with a smart thermostat 250 for the HVAC system.

FIG. 11 shows another monitoring system 200 that is integrated with a smart thermostat 250 for the HVAC system. FIG. 11 shows the monitoring system 200 as adjacent and distinct from the smart thermostat 250 in order to convey the added capabilities of such a system. Those of skill in the art will appreciate that one housing would likely include both sets of functionalities and the functions of the monitoring system 200 and smart thermostat 250 would likely be accomplished using the same processor and memory rather than having a distinct process and memory for the monitoring device.

In this embodiment, there is not a need for an indoor humidity value to detect the operation of the HVAC system. The smart thermostat 250 will be able to provide to the monitoring system 200 the following information:

Whether the HVAC system is running or idle.

If running, whether the HVAC is in COOL mode or Heat mode (fan only will count as idle).

The Set Point for the Smart Thermostat for use in the ΔT calculations.

The monitoring system 200 will not need a Wi-Fi transceiver as part of a communication route to access the outside temperature from a third-party provider providing local outdoor weather data 108 or to route stored data to the cloud 107 the smart thermostat 250 has a Wi-Fi transceiver 255 that is connected to the home's Wi Fi transceiver 205 which in turn is connected to the internet 106.

The monitoring system 200 may use its own memory or memory associated with the smart thermostat 250 to periodically store mode/running or idle/and set point temperature. For example, the monitoring system may store this array of data values 50 times an hour so that a two-hour lookback period would have 100 samples. At the cessation of each runtime, the monitoring system 200 may access the outdoor temperature from third party source of outdoor weather data 108 or an external temperature monitor 290. Thus, at the cessation of each runtime, the monitoring system can send a data record to the cloud 107 that includes date, time, mode, ΔT, and runtime percentage over the lookback window.

One of skill in the art will appreciate that the storage in the cloud 107 will need to segregate data from house A from house B. This could be done using a unique ID provided by the monitoring system 200 or the unique identifier from the smart thermostat 250.

One of skill in the art will appreciate that the data record could use values for ΔT Heat and ΔT Cool in each record rather than mode and ΔT.

As before the performance of the HVAC system within a given mode can be compared to other HVAC systems and to prior performance of this HVAC system by either looking at performance tuples having mode/ΔT/runtime percentage and comparing to other values have a similar mode/ΔT or the performance tuple may be converted to a performance indicator value by using any mapping of tuple to performance indicator.

As noted elsewhere, the performance tuple for times when the ΔT value is less than a threshold (such as 10 degrees) may be discarded.

Alternatives and Variations

Humidity Sensors.

Those of skill in the art will appreciate that a wide range of electronic humidity sensors area available. Some measure relative humidity and some measure absolute humidity. The present disclosure does not require the use of a particular type of humidity sensor. Any sensor that can provide information to a processor may be used. The teachings of this disclosure will work with either a sensor that measures relative humidity or a sensor that measures absolute humidity. As the process merely requires detection that the humidity (relative or absolute) is decreasing, the conversion of the electrical output to a specific humidity value is not required. Likewise, it is not necessary to calibrate the humidity device to provide accurate humidity readings. A brief introduction to electronic measurement of humidity may be found at https://www.electronicshub.org/humidity-sensor-types-working-principle/

Monitoring Device without Humidity Sensor.

A monitoring device such as described in connection with FIG. 1 or FIG. 8 could operate in accordance with the teachings of the present disclosure without the use of a humidity sensor. The difference in operation would be that start of a runtime would be determined by a change in direction of the temperature measurement. The end of the runtime would be determined by a reversal of direction of temperature. The temperature at the end of the runtime would be compared to the outside temperature. If the absolute value of ΔT is less than a threshold value, the data is discarded as not reliable. This threshold value can be called the ambiguity threshold as data collected with absolute values of ΔT of less than the ambiguity threshold is ambiguous on whether the HVAC system is clear in heat mode or clearly in cool mode.

For example an ambiguity threshold of an value of 10 degrees Fahrenheit might be used, although other number may be used. Thus, a runtime that drops the temperature measured by the monitoring device down to 70 degrees when the outside temperature is 85 degrees is highly likely to be a valid data set for a cooling event. Likewise a runtime that moves the temperature measured by the monitoring device up to 70 degrees when the outside temperature is 55 degrees is highly likely to be a heating event. Both of these events have an value of ΔT that is less than 10 degrees Fahrenheit.

One of skill in the art will appreciate that ΔT for heat would be indoor temperature minus outdoor temperature and ΔT for cool would be outdoor temperature minus indoor temperature. However, if data is always stored as outdoor temperature minus indoor temperature then the ambiguity threshold for heat would remain 10 degrees Fahrenheit but would require a ΔT of less than negative 10 degrees Fahrenheit for a cooling event to be recorded. To repeat the example provided above, a runtime that drops the temperature measured by the monitoring device down to 70 degrees when the outside temperature is 85 degrees is highly likely to be a valid data set for a cooling event as 70-85 would be less than negative 10 degrees Fahrenheit.

One of skill in the art will appreciate that the ambiguity thresholds may not be symmetric around the indoor set point. For example the ambiguity threshold for being sure that it a heat event may be less than the ambiguity threshold for being sure that it is a cooling event or vice versa.

Discarding the data values for situations where ΔT is below the ambiguity threshold is not a significant loss of data as the important tests for the HVAC unit are when the ΔT values are high.

Only One Efficiency Measured.

The disclosure discusses measuring a cool system performance 115 and a heat system performance 135. One of skill in the art will appreciate that the teachings of this system may be used in situations that do not have both a heating and cooling system or where the user is not interested in monitoring both systems. A user in Alaska may not have a cooling system as but may be interested in monitoring just the heat system efficiency. A user in Hawaii may have some a system that both heats and cools the residence but may not be interested in monitoring the heat system efficiency that is rarely used.

HVAC System.

In many instances, a homeowner will have one system that delivers heated air and cooled air to a set of registers in a home. Thus, there will be one system that provides Heating, Ventilation, and Air Conditioning (HVAC). In other parts of the country a heating system that uses hot water for radiant heat may be serving a residence in the winter and a second system that delivers cool air to registers operates in the summer. The present disclosure measures the heat system efficiency and cool system efficiency independently and the two measurements could apply to different systems rather than one unified HVAC system.

Access to Outside Temperature.

This disclosure set forth accessing the local temperature through use of a communication link to a source on the Internet that provides weather information based upon a Postal Code. Those of skill in the art will appreciate that some online weather systems use longitude and latitude to provide weather information. The National Weather Service use a grid system of 2.5 kilometers. A user can be matched to the proper grid for weather data using longitude and latitude. A less precise weather data set may be obtained by providing a city name such as Raleigh, Durham, or Cary.

While the process uses outside temperature in order to assess the time taken to heat or cool the air in the context of the ΔT between the outdoor temperature and the apparent thermostat set point, the process can use outside temperatures that are obtained directly from a web site using the HTML, via an API data file, or indirectly from a server that buys and stores the relevant weather data for use by many different monitoring devices.

Direct Measurement of Outside Temperature.

Those of skill in the art will appreciate that instead of accessing a third-party data set for the local temperature, that one could place a temperature measurement device outside of the building that communicates with the monitoring device via wireline carrier or a wireless communication protocol.

Alternative Thermal Load Metrics.

The present disclosure uses ΔT as the thermal load metric. Thus, the performance of an HVAC system can be compared by % runtime and the ΔT thermal load metric. An HVAC unit that averaged a 45% runtime for a given ΔT last month but is now needed a 50% runtime for the same ΔT may benefit from a service call.

One of skill in the art will appreciate that ΔT could be determined by the difference between the indoor temperature at the end of HVAC runtime and the outdoor temperature at the end of the runtime as is disclosed above. Alternative calculations of ΔT could use the indoor and outdoor temperatures at the beginning of the runtime. Alternative calculations could use an average of the indoor temperature at the beginning and end of the runtime. Alternative calculations could use an average of the outdoor temperature at the beginning and end of runtime. Alternative calculations could use an average of the outdoor temperature at the end to the most recent runtime and the beginning of the lookback window as the average outdoor temperature over the entire lookback window would impact the runtime percentage.

One could construct a more complicated thermal load metric that takes into account additional factors beyond outdoor temperature. Those of skill in the art will appreciate that wind speed, outdoor humidity, cloud cover, sun position, and other factors may be used to adjust the thermal load metric. One of skill in the art will appreciate that an HVAC unit will work harder to cool with a ΔT of 20 degrees and a bright sunny day than the same HVAC unit with a ΔT of 20 degrees after sundown. The tradeoff for designers is in deciding whether small improvements in accurately modeling thermal load justify the added complexity to the calculations given that a simple ΔT thermal load metric is sufficient to identify an HVAC system that is not performing as well as it did at an earlier time.

Conversion of Performance Tuples to Performance Metrics.

Those of skill in the art will appreciate that the easiest comparisons are comparing runtime percentages for two sets of readings that have the same mode and ΔT. Individual performance monitoring services may wish to have performance metrics as a single value rather than a tuple.

The specifics of converting a tuple to a single performance metric value is beyond the scope of this disclosure as many different options exist. For simplicity, one can envision a matrix of performance values so that inputting a ΔT and runtime percentage for a given mode yields a performance value just as inputting two values into a thermodynamic steam table allows a look up of a third value. When using the steam table, one needs to round off the X and Y values to the level of granularity of the steam table. Tables for performance values can be constructed with the level of granularity of the tuple values such as ΔT increments of 0.1 degree or 1 degree depending on what is going to be reported. Likewise if runtime percentages will be reported as rounded to the nearest percent, then the level of granularity of the table need only be down to one percent.

Thus, all of the tuple pairs represented on FIG. 9 as the lower end of area 124 adjacent to area 126 would have a similar performance metric value, perhaps B− or a number such as 87. Likewise, all of the tuple pairs represented on FIG. 9 as the upper end of area 124 adjacent to area 125 would have a similar performance metric value, perhaps B+ or a number such as 92.

Time to Temperature Monitoring.

An alternative to a performance tuple of ΔT and runtime percentage over a lookback window is to collect data for a performance tuple of ΔT and time to temperature. In this alternative, the ΔT value is determined as set forth elsewhere in this disclosure. But instead of using the runtime percentage over the relatively long lookback window, the second component is the time between onset of heating and or cooling and the time to reach the thermostat setpoint.

This performance tuple will be of some use in noticing that the rolling average for time to temperature for a given ΔT rises over time. As the difference between trigger point and set point for thermostats is not all the same, comparing a time to temperature reading for a thermometer with a one-degree difference between trigger temperature and setpoint temperature with a thermometer with a two-degree difference between trigger temperature and setpoint temperature will not be useful. If such a comparison is required then the performance tuple may need to be ΔT, time to temperature per degree difference between trigger temperature and setpoint temperature where trigger temperature is the indoor temperature at the start of a runtime and the setpoint temperature is the indoor temperature at the end of a runtime.

Communication of Performance Status.

The performance tuples for the or the performance metrics for the heat system and the cool system may be accessed from where this material is stored by a user having rights to access. The users with such rights may include the homeowner, a tenant within rental property including an office condominium, a property manager including a manager of a multi-unit building, and an HVAC contractor or HVAC monitoring service that is monitoring HVAC data for one or more users in order to alert a user when maintenance may be required.

In addition to allowing a user to access the stored data, certain changes in performance status may trigger a notice to be sent out to one or more users. The notice format may include text notifications to mobile phones, email messages, and possibly an indicator light on the monitoring device or smart thermostat. Those of skill in the art will appreciate that there are a number of different ways to convey an alert to an end user and these known communication techniques are all within the scope of the teachings of the present disclosure.

One of skill in the art will recognize that some of the alternative implementations set forth above are not universally mutually exclusive and that in some cases additional implementations can be created that employ aspects of two or more of the variations described above. Likewise, the present disclosure is not limited to the specific examples or particular embodiments provided to promote understanding of the various teachings of the present disclosure. Moreover, the scope of the claims which follow covers the range of variations, modifications, and substitutes for the components described herein as would be known to those of skill in the art.

Where methods and/or events described above indicate certain events and/or procedures occurring in a certain order, the ordering of certain events and/or procedures may be modified. Additionally, certain events and/or procedures may be performed concurrently in a parallel process, when possible, as well as performed sequentially as described above.

The legal limitations of the scope of the claimed invention are set forth in the claims that follow and extend to cover their legal equivalents. Those unfamiliar with the legal tests for equivalency should consult a person registered to practice before the patent authority which granted this patent such as the United States Patent and Trademark Office or its counterpart.

What is claimed is:

1. A process for monitoring performance of at least one mode of an HVAC system, the process comprising:

periodically storing a temperature representative of ambient air temperature in a portion of a building treated by the HVAC system;

after detection that the HVAC system is in heat mode, create a heat performance tuple that includes:

a heat ΔT value that equals a difference in temperature between a thermostat set point for the HVAC system in heat mode and a particular value representative of an air temperature outside the building; and a heating runtime percentage based on a percentage of a set of stored temperatures representative of ambient air temperature in the portion of the building treated by the HVAC system that indicate the HVAC system is in heat mode taken compared with a heating total number of stored temperatures representative of ambient air temperature in the portion of the building treated by the HVAC system, the heating runtime percentage taken over a heating lookback period that ends with an end of a most recent heat runtime;

storing the heat performance tuple along with a date and a time for the end of the most recent heat runtime; and after detection that the HVAC system is in cool mode, create a cool performance tuple that includes:

a cool ΔT value that equals a difference in temperature between a specific value representative of an air temperature outside the building and a thermostat set point for the HVAC system in cool mode; and a cooling runtime percentage based on a percentage of a set of stored temperatures representative of ambient air temperature in the portion of the building treated by the HVAC system that indicate the HVAC system is operating in cool mode taken compared with a cooling total number of stored temperatures representative of ambient air temperature in the portion of the building treated by the HVAC system, the cooling runtime percentage taken over a cooling lookback period that ends with an end of the most recent cool runtime; and storing the cool performance tuple along with a date and time for the end of the most recent cool runtime.

2. The process of claim 1 wherein the temperature representative of ambient air temperature in the portion of the building is obtained from a temperature sensor in a monitoring device that does not have access to a thermostat controlling the HVAC system; and the monitoring device is adapted to communicate with resources connected to a Internet.

3. The process of claim 2 wherein the monitoring device uses Wi-Fi communication to reach resources connected to a Internet.

4. The process of claim 1 wherein values representative of the air temperature outside the building including the particular value and the specific value, come from a third-party source of weather data on a Internet.

5. The process of claim 1 wherein values representative of the air temperature outside the building including the particular value and the specific value, come from an outside temperature monitoring sensor located outside of the building but accessible via a communication pathway that does not include a Internet.

6. The process of claim 1 wherein detection that the HVAC system is running in heat mode includes:

determining that a humidity reading for the portion of the building treated by the HVAC system is less than a set of at least one recent humidity readings; and determining that the temperature representative of ambient air temperature in the portion of a building treated by the HVAC system is rising relative to a set of at least one recent recorded temperatures.

7. The process of claim 1 wherein detection that the HVAC system is running in heat mode includes accessing mode information from a thermostat controlling the HVAC system.

8. The process of claim 1 wherein storing the heat performance tuple along with the date and time for the end of the most recent heat runtime includes discarding heat performance tuples where the heat ΔT value is less than an ambiguity threshold.

9. The process of claim 1 wherein detection that the HVAC system is running in cool mode includes:

determining that a humidity reading for the portion of the building treated by the HVAC system is less than a set of at least one recent humidity readings; and determining that the temperature representative of ambient air temperature in the portion of a building treated by the HVAC system is falling relative to a set of at least one recent recorded temperatures.

10. The process of claim 1 wherein detection that the HVAC system is running in cool mode includes accessing mode information from a thermostat controlling the HVAC system.

11. The process of claim 1 wherein the heat performance tuple is created within the building treated by the HVAC system.

12. The process of claim 11 wherein the heat performance tuple is created within a monitoring device independent of a thermostat connected to the HVAC system.

13. The process of claim 11 wherein the heat performance tuple is created within a thermostat unit that controls the HVAC system.

14. The process of claim 1 wherein the heat performance tuple is created outside of the building treated by the HVAC system by a processor that receives data from within the portion of the building treated by the HVAC system via a communication path that includes an Internet.

15. The process of claim 1 wherein a recently stored heat tuple is compared with a set of at least one previously stored heat tuple having a similar ΔT and a degradation of heat performance by the HVAC system is communicated to at least one user interested in HVAC system performance.

16. The process of claim 1 wherein the heat performance tuple is converted into a heat performance metric so that a recently stored heat performance metric may be compared with at least one previously stored heat performance metric from at least one heat performance tuple with a ΔT different from the heat performance tuple used to create the recently stored heat performance metric.

17. A process for monitoring performance of at least one mode of an HVAC system using information from a thermostat for that HVAC system, the process comprising:

periodically storing in memory, information that includes: current mode of operation for the HVAC system; and whether the HVAC system is active or idle upon detection that the HVAC system has completed a runtime in heat mode, create a heat performance tuple that includes:

a heat ΔT value that equals a difference in temperature between a thermostat set point for the HVAC system in heat mode and a particular value representative of an air temperature outside a building that the HVAC system is servicing; and a heating runtime percentage based on a percentage of stored values that indicate that the HVAC system was active taken over a heating lookback period that ends with an end of a most recent heat runtime;

storing the heat performance tuple along with a date and a time for the end of the most recent heat runtime; and wherein the heat performance tuple is converted into a heat performance metric so that a recently stored heat performance metric may be compared with at least one previously stored heat performance metric from at least one heat performance tuple with a ΔT different from the heat performance tuple used to create the recently stored heat performance metric; and upon detection that the HVAC system is running in cool mode, create a cool performance tuple that includes:

a cool ΔT value that equals a difference in temperature between a specific value representative of an air temperature outside the building and a thermostat set point for the HVAC system in cool mode;

a cooling runtime percentage based on a percentage of stored values that indicate that the HVAC system was active taken over a cooling lookback period that ends with an end of the most recent cool runtime; and storing the cool performance tuple along with a date and time for the end of the most recent cool runtime; and wherein the cool performance tuple is converted into a cool performance metric so that a recently stored cool performance metric may be compared with at least one previously stored cool performance metric from at least one cool performance tuple with a ΔT different from the cool performance tuple used to create the recently stored cool performance metric.

18. A monitoring device for monitoring a heat performance of an HVAC system, the monitoring device comprising:

a processor for executing instructions and moving information from one component to another component;

a memory for storing instructions for execution by the processor and for storing data;

a temperature sensor for measuring an air temperature at the monitoring device;

a means for obtaining an outdoor air temperature for air outside of a building containing the monitoring device;

a means for communicating to an Internet connected storage location;

the monitoring device having instructions to enable the monitoring device to:

periodically store the air temperature provided by the temperature sensor;

detect that a most recently obtained air temperature is higher than a set of at least one recently stored air temperatures and deeming that to be an indication that the HVAC heat system is on; and detect that the most recently obtained air temperature is not higher than a set of at least one recently stored air temperature and deeming that to be an indication that the HVAC heat system is idle;

after detecting that the HVAC heat system became idle after a period of time when the HVAC heat system was on, create a heat performance tuple that includes:

a heat ΔT value that equals a difference in temperature between a temperature where the HVAC system became idle after being on and a value representative of an air temperature outside the building; and a runtime percentage based on the percentage of the obtained temperatures that indicated that the HVAC heat system was on over a lookback period that ends a most recent instance of the HVAC heat system becoming idle after a period of time when the HVAC heat system was on; and storing the heat performance tuple along with a date and time for the most recent instance of the HVAC heat system becoming idle after a period of time when the HVAC heat system was on.

19. The device of claim 18 further comprising a humidity sensor; and wherein the monitoring device having instructions to enable the monitoring device to:

periodically store a humidity measurement provided by the humidity sensor;

detect that a most recently obtained humidity measurement is not lower than a set of at least one recently stored humidity measurement and deeming that to be an indication that the HVAC heat system is idle;

detect that the most recently obtained humidity measurement is lower than a set of at least one recently stored humidity measurement and deeming that to be an indication that the HVAC heat system is on; and ignoring detections that the HVAC heat system became idle after a period of time when the HVAC heat system was on unless both a set of temperatures and a set of humidity readings indicate that the HVAC heat system was on.

20. The device of claim 18 wherein the heat performance tuples with a ΔT of less than an ambiguity threshold value are not stored.

21. The device of claim 18 wherein storing the heat performance tuple along with a date and time for the most recent instance of the HVAC heat system becoming idle after a period of time when the HVAC heat system was on uses storage on a device within a cloud in communication with the Internet.

* * * * *